United States Patent [19]

Silbernagel et al.

[11] 4,326,767

[45] Apr. 27, 1982

[54] WIRE CUTTING ELECTRICAL CONNECTOR

[75] Inventors: Raymond A. Silbernagel, Ramsey; Garry L. Sjolander, Maplewood, both of Minn.

[73] Assignee: Minnesota Mining and Manufacturing Company, St. Paul, Minn.

[21] Appl. No.: 107,887

[22] Filed: Jan. 14, 1980

Related U.S. Application Data

[63] Continuation-in-part of Ser. No. 19,577, Mar. 12, 1979, abandoned.

[51] Int. Cl.[3] ..... H01R 4/24

[52] U.S. Cl. ..... 339/98

[58] Field of Search ..... 339/97 R, 97 P, 98, 339/99, 103 R

[56] References Cited

U.S. PATENT DOCUMENTS

| | | | |
|---|---|---|---|
| 3,609,644 | 9/1971 | Seim | 339/98 |
| 3,718,888 | 2/1973 | Pasternak | 339/98 |
| 3,804,971 | 4/1974 | Bazille | 339/98 X |
| 3,835,444 | 9/1974 | Plana et al. | 339/98 |
| 3,865,460 | 2/1975 | Cherney et al. | 339/98 |
| 3,955,873 | 5/1976 | Peterson | 339/99 R |
| 3,958,853 | 5/1976 | Wilson | 339/99 R |
| 4,074,929 | 2/1978 | Krider | 339/103 R X |
| 4,157,208 | 6/1979 | Roberts | 339/98 |

FOREIGN PATENT DOCUMENTS

| | | | |
|---|---|---|---|
| 2034538 | 6/1980 | United Kingdom | 339/98 |

*Primary Examiner*—Joseph H. McGlynn
*Assistant Examiner*—John S. Brown
*Attorney, Agent, or Firm*—Cruzan Alexander; Donald M. Sell; Terryl K. Qualey

[57] ABSTRACT

An electrical wire connector having an insulating body and cover, a conductive contact element and a wire cut-off blade. The cap and body telescope together to force wires into the contact element and to force the wires against the cut-off blade to sever the ends of the wires and the cap and body have cooperating parts to close off the end of the body adjacent the severed wire ends.

17 Claims, 12 Drawing Figures

WIRE CUTTING ELECTRICAL CONNECTOR

CROSS REFERENCE TO RELATED APPLICATION

This application is a continuation-in-part of application Ser. No. 19,577 filed Mar. 12, 1979, now abandoned.

FIELD OF THE INVENTION

The present invention relates to an electrical wire connector for simultaneously connecting and severing electrical wires.

BACKGROUND OF THE INVENTION

Connectors for terminating electrical wires have most often required the wire ends to be pushed into openings in one end of the connector until they contact an abutment within the connector. Telescoping parts are then moved together to force the wires into a contact element to complete the electrical connection. A waterproof grease is frequently provided between the telescoping parts to make the final connection water resistant. Such connectors are disclosed in U.S. Pat. Nos. 3,573,723 and 3,656,088. It has been found that users of such connectors sometimes do not insert the wire ends far enough into the connectors and electrical connection is not made when the parts are moved together. Also, it has been found that occasionally plastic wire insulation stretches sufficiently that it extends beyond the conductor so that even though the wire end is inserted into the connector against the abutment only the wire insulation is forced into the contact element and again the wire connection is not made.

An earlier wire connector disclosed in U.S. Pat. No. 3,202,957 makes good connection to the wires by extending the wire openings through the connector body. The wire ends extend out of the connector prior to connection and a severing blade cuts the wire at the same time as the contact element makes connection to it. However, this connector suffers from the difficulty that it cannot be readily waterproofed. Even though a waterproof grease could be provided within the connector body, when the wire is severed and the severed end removed from the connector body a channel is provided to the contact element through which water could enter the connector and short out the connection.

SUMMARY OF THE INVENTION

The present invention provides a wire connector having an insulating body, an insulating cover and a conductive wire connector element. The body is hollow and open-topped with a base wall, a pair of generally parallel side walls extending generally perpendicularly from the base wall and an end wall extending from the base wall between the side walls at one end of the body. The upper edge of at least a portion of the end wall is inclined at an acute angle to the base wall and the end of the body opposite the end wall is open for access by at least one wire. The wire connector element is U-shaped and resilient with the legs of the U being wide and thin. One of the legs is formed with at least one wire connecting slot extending from the top of the leg toward the base of the U and the second leg is sharpened along its top edge in alignment with at least one wire connecting slot in the first leg. The connector element is positioned in the body with the base of the U on the base wall of the body and the sharpened second leg abutting and extending above the inclined portion of the body end wall. The cover and body are formed to telescope together. The cover is formed to carry a wire into each connector element slot and to cooperate with the sharpened second leg of the connector element to sever at least one wire extending through the connector upon telescoping of the cover and body fully together. The body and cover are formed to seal the end of the connector adjacent the sharpened second leg of the connector element when the body and cover are fully telescoped together. They are also formed with complementary latch members to retain the body and cover in an open position to permit at least one wire to be inserted into the body end that is open for wire access and through said connector between the body and cover, and to retain the body and cover in a crimped position with the body and cover fully telescoped together.

When the cover and body are telescoped together the cover forces a wire into each slot in the contact element and simultaneously forces at least one wire against the sharpened leg of the contact element which acts as a cut-off blade to sever the wire end. The connector end seal closes the end of the body after the wire end has been severed.

THE DRAWING

Figure 1:
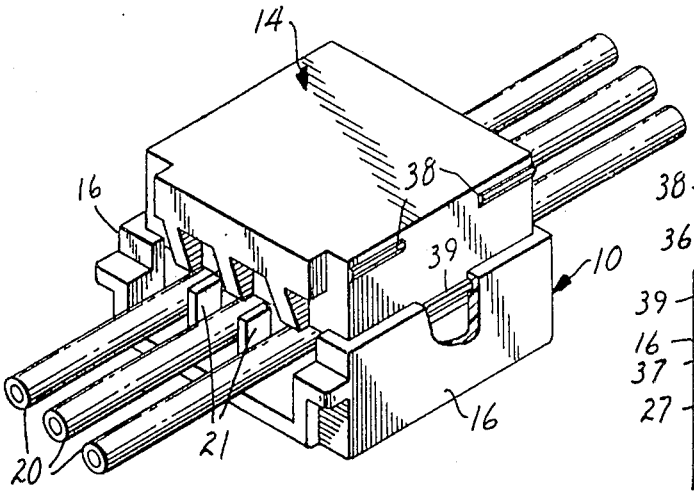
FIG. 1 is a perspective view of a first embodiment of the wire connector of the present invention in a fully open position with wires inserted therethrough.
Figure 3:
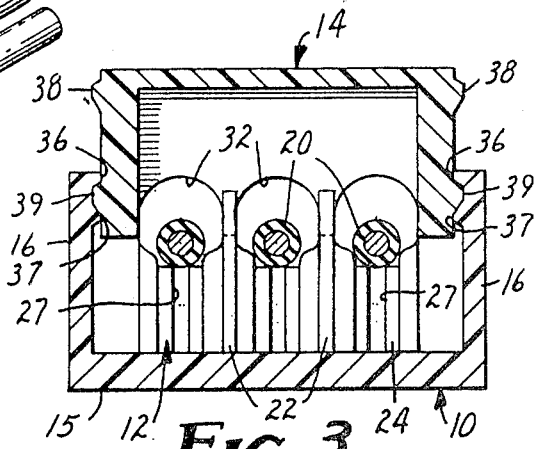
FIG. 3 is a cross-sectional view taken generally along line 3—3 of FIG. 2.
Figure 2:
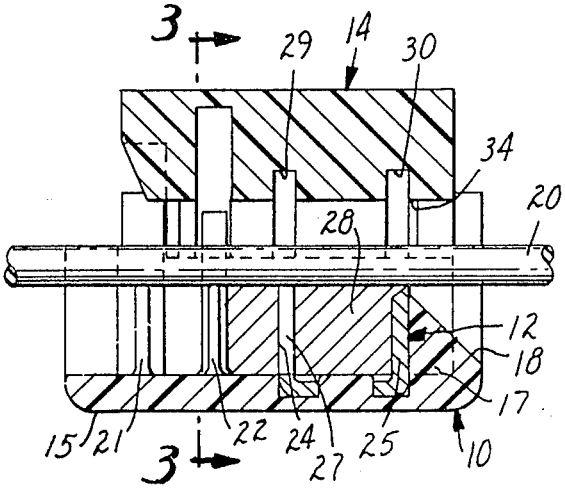
FIG. 2 is a longitudinal cross-sectional view of the connector of FIG. 1 in the fully open position.

Referring now to the embodiment of FIGS. 1–7, the wire connector of the present invention comprises a hollow, open-topped, insulating body 10, a U-shaped, resilient, conductive wire connector element 12 and an insulating cover 14 formed to telescope into the body 10.

The body 10 has a base wall 15, a pair of generally parallel side walls 16 that extend generally perpendicularly from the base wall and an end wall 17 extending from the base wall 15 between the side walls 16 at one end of the body. The upper edge 18 of the body end wall 17 is inclined at an acute angle to the base wall 15. The end of the body 10 opposite the end wall 17 is open for access by insulated wires 20. Adjacent the open end of the body 10 two transverse rows of dividers 21 and 22 extend from the base wall 15 in lines transverse of the body to define three parallel wire access passageways that are slightly narrower than the insulated wires 20.

The legs 24 and 25 of the U-shaped wire connector element 12 are wide and thin. One leg 24 is formed with three wire connecting slots 27 extending from the top of the leg 24 toward the base of the U. The second leg 25 is sharpened along its top edge. The connector element 12 is positioned in the body 10 with the base of the U on the base wall 15 of the body, the sharpened leg 25 abutting and extending above the body end wall 17 and the wire connecting slots 27 aligned with the passageways defined by the dividers 21 and 22. A waterproof grease 28 fills the body cavity between dividers 22 and end wall 17 including the space within the U of the connector element 12.

The cover 14 is formed to telescope into the body 10 between the body side walls 16. The cover is formed with a pair of parallel transverse slots 29 and 30 to receive the legs 24 and 25, respectively, of the connector element 12. It is also formed with three longitudinal wire support channels 32 aligned with the slots 27 in the wire connector element 12 to carry wires 20 into the slots 27 upon telescoping of the cover 14 fully into the body. The end of the cover 14 over the inclined edge 18 of the body end wall 17 is formed with a sharp corner 34 to contact the inclined edge 18. The corner 34 contacts the inclined body edge 18 when the cover 14 is fully telescoped into the body 10 to close the end of the connector.

The body 10 and cover 14 are formed with complementary latch members defined by longitudinal ribs 36 and 37 on the interior of both body side walls 16 and ribs 38 and 39 on the exterior of both cover side walls. In the fully open position of the connector, illustrated in FIGS. 1, 2 and 3, the lower ribs 39 on the cover fit between the ribs 36 and 37 on the body. In this position the wires 20 may be slid between the body 10 and cover 14 in the wire support channels 32.

Figure 4:
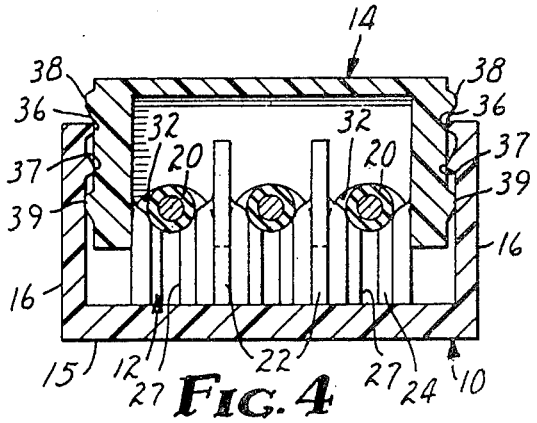
FIG. 4 is a cross-sectional view similar to that of FIG. 3 with the cover telescoped into the body to a precrimped position to hold the wires in place.

The cover may then be telescoped into the body to the precrimped position illustrated in FIG. 4 by finger pressure on the cover. This moves the cover to a position where its latching ribs 38 and 39 lie on either side of the body ribs 36 and 37 and its channels 32 press the insulated wires 20 against the top of the connector element 12 to frictionally retain the wires in their position in the connector.

Figure 5:
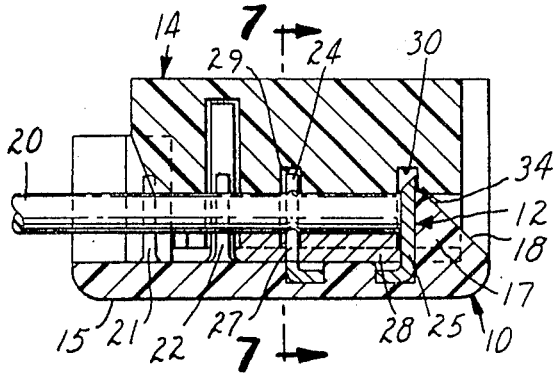
FIG. 5 is a longitudinal cross-sectional view similar to that of FIG. 2 with the connector in the fully crimped position.
Figure 6:
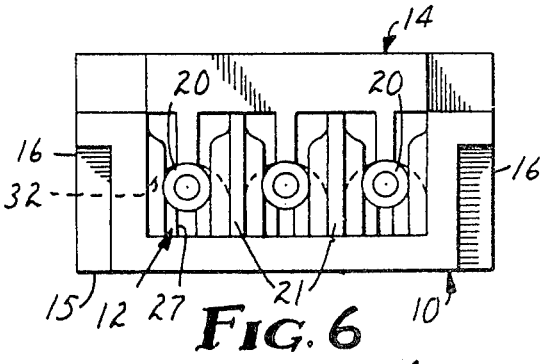
FIG. 6 is an end view of the connector of FIG. 1 in the fully crimped position as viewed from the left end in FIG. 5.
Figure 7:
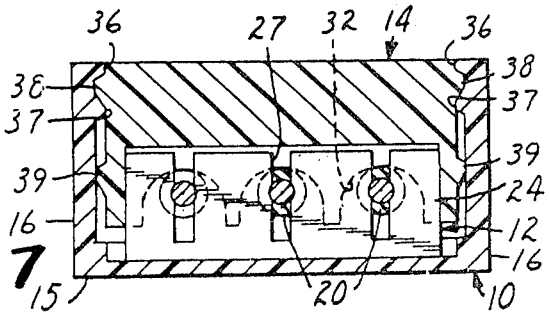
FIG. 7 is a cross-sectional view taken generally along line 7—7 of FIG. 5.
Figure 8:
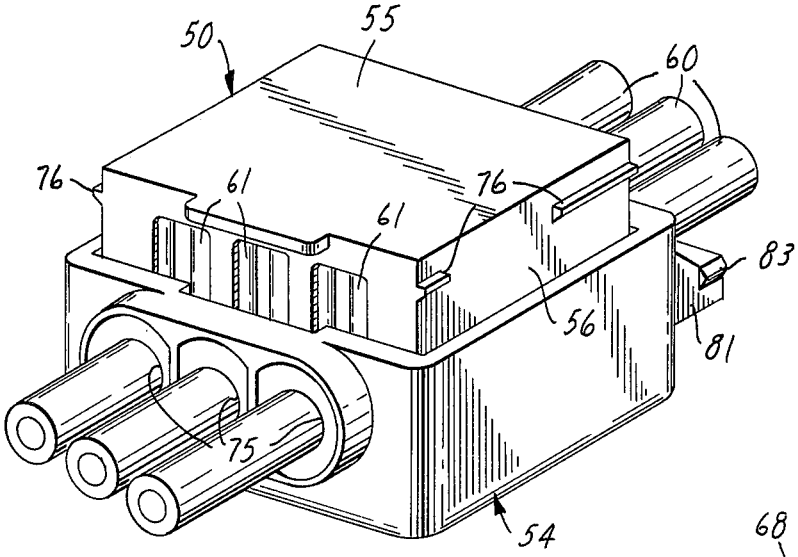
FIG. 8 is a perspective view of a second embodiment of the wire connector of the present invention in a fully open position with wires inserted therethrough.

The cover is fully crimped into the body to the position illustrated in FIGS. 5, 6 and 7 by a pliers type tool which telescopes the cover 14 into the body 10 until its upper ribs 38 lie between the ribs 36 and 37 on the body. As the cover is moved to its fully crimped position the channels 32 carry the wires 20 into the dividers 21 and 22, into the slots 27 in the connector element 12, and against the sharpened cut-off leg 25 of the connector element. In the dividers 21 and 22 the insulation on the wire 20 is indented to provide strain relief. In the slots 27 the insulation is pierced and connection is made to the conductor as the cover forces the wire ends against the sharpened leg 25 to cut off the wire ends. The incline on the upper edge 18 of the body end wall 17 causes the wire ends to be expelled from the connector as they are severed. As the cover 14 is being moved from the precrimped to the fully crimped position the grease 28 is extruded around the wire connections. The wire ends are severed and expelled before the cover reaches the fully crimped position and thereafter grease is extruded into and fills the area vacated by the severed wire ends to make the connection reliably water resistant.

Referring now to the embodiment of the present invention illustrated in FIGS. 8–12, this embodiment also comprises a hollow, open-topped insulating body 50, a U-shaped, resilient, conductive wire connector element 52 and an insulating cover 54. The parts in this embodiment are essentially inverted from those of the first embodiment and the body 50 telescopes into the cover 54 instead of the cover telescoping into the body.

The body 50 has a base wall 55, a pair of generally parallel side walls 56 that extend generally perpendicularly from the base wall and an end wall 57 extending from the base wall 55 between the side walls 56 at one end of the body. The upper edge 58 of the body end wall 57 is inclined at an acute angle to the base wall 55 across the width thereof spanning the wire positions through the connector. The end of the body 50 opposite the end wall 57 is open for access by insulated wires 60. Adjacent the open end of the body 50 two transverse rows of dividers 61 and 62 extend from the base wall 55 in lines transverse of the body to define three parallel wire passageways that are slightly narrower than the insulated wires 60.

The legs 64 and 65 of the U-shaped wire connector element 52 are wide and thin. One leg 64 is formed with three wire connecting slots 67 extending from the top of the leg 64 toward the base of the U. The second leg 65 is sharpened along its top edge in alignment with the wire connecting slots 67 in the first leg 64. Four stabilizing post 66 formed with barbed ends extend from the top edge of leg 65, one post 66 to each side of the wire positions through the connector element 52. The connector element 52 is positioned in the body 50 with the base of the U on the base wall 55 of the body, the sharpened leg 65 abutting and extending above the body end wall 57 and the wire connecting slots 67 aligned with the wire passageways defined by the dividers 61 and 62. a waterproof grease 68 fills the body cavity between the dividers 62 and end wall 57 including the space within the U of the connector element 52.

The cover 54 is hollow and open topped to telescopically receive the body 50. The cover is formed with parallel transverse slots 69 and 70 to receive the legs 64 and 65, respectively, of the connector element 52 and four wells 71 are formed to receive the posts 66 extending from the sharpened leg 65 of the connector element 52. Narrow ribs 72 extend across the slot 69 in alignment with each of the three wire connecting slots 67 to provide support for the wires 60 for insertion into the slots 67 upon telescoping of the body 50 into the cover 54. Similar ribs 73 provide for insertion of the wires 60 between the dividers 61 and 62. At the end of the cover 54 adjacent the wire access end of the body 50 the cover is formed with three wire insertion ports 75 aligned with the wire passageways between the dividers 61 and 62 and the wire slots 67 in the connector element 52 to aid in insertion and guiding of the wires 60 through the connector between the body 50 and the cover 54 in their fully open position.

The body 50 and the cover 54 are formed with complementary latch members defined by longitudinal ribs 76 and 77 on the exterior of both body side walls 56 and ribs 78 and 79 on the interior of both cover side walls. In the fully open position of the connector, illustrated in FIGS. 8–10 the lower ribs 77 on the body fit between the ribs 78 and 79 on the cover. In this position the wires 60 may be slid into the wire insertion ports 75 and through the connector between the body 50 and the cover 54.

The body 50 may then be telescoped into the cover 54 by finger pressure to the precrimped position in which the body latching ribs 76 and 77 lie on either side of the cover ribs 78 and 79. In this position the body 50 and cover 54 frictionally engage the wires 60 between them. The barbed ends of the stabilizing posts 66 on the connector element 52 bite into the sidewalls of the wells 71 in the cover to aid in retaining the body and cover in this position.

Figure 11:
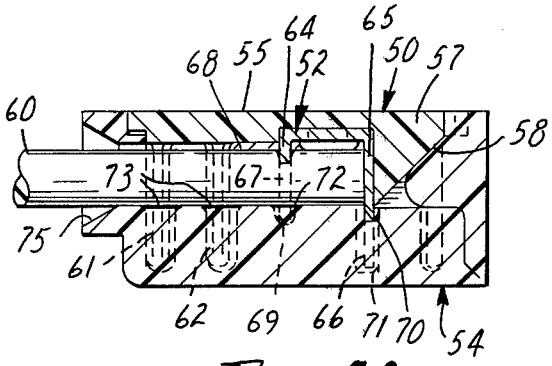
FIG. 11 is a longitudinal cross-sectional view similar to that of FIG. 9 with the connector in the fully crimped position and the door closed.
Figure 9:
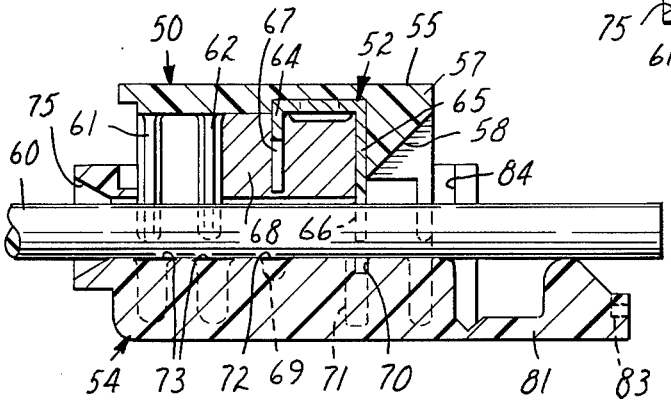
FIG. 9 is a longitudinal cross-sectional view of the connector of FIG. 8 in the fully open position.
Figure 10:
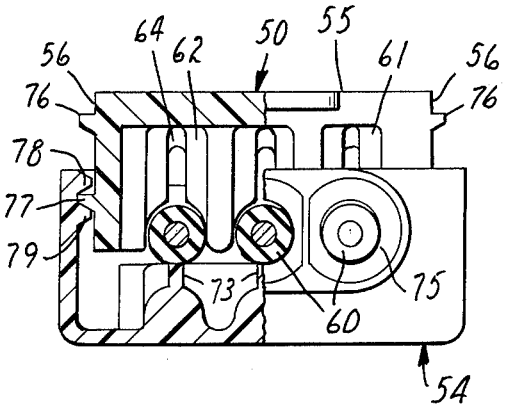
FIG. 10 is an end view of the connector of FIG. 8 as viewed from the left end in FIG. 9, with parts broken away.
Figure 12:
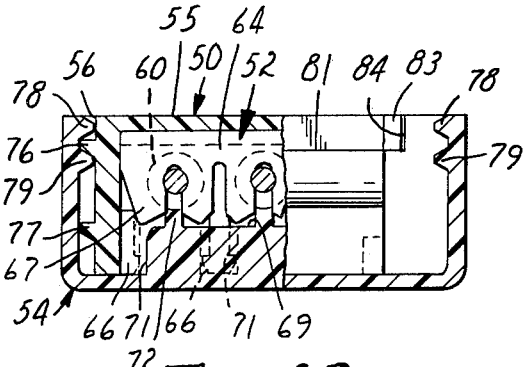
FIG. 12 is a transverse cross-sectional view of the connector of FIG. 8 as viewed from left to right in FIG. 11, at two depths, one to either side of the vertical break line.

The body is fully crimped into the cover to the position illustrated in FIGS. 11 and 12 by a pliers-type tool which telescopes the body 50 into the cover 54 until its upper ribs 76 lie between the ribs 78 and 79 on the cover. As the body is moved to its fully crimped position the wire insertion ribs 73 carry the wires into the dividers 61 and 62, the wire insertion ribs 72 carry the wires 60 into the connector elememt slots 67 and the sharpened cut-off leg 65 cuts through the wires and moves into slot 70. In the dividers 61 and 62 insulation on the wire 60 is indented to provide strain relief. In the slots 67 the insulation is pierced and connection is made to the conductor as the cover forces the wire ends against the sharpened leg 65 to cut off the wire ends. The stabilizing post 66 prevent deflection of the sharpened cut-off leg 65 by the wires and the barbed ends thereof bite into the sidewalls of the wells 71 in the cover to aid in retaining the body and cover in the fully crimped position. The incline on the upper edge 58 of the body end wall 57 causes the wire ends to be expelled from the connector as they are severed. As the body 50 is moved from the precrimped to the fully crimped position the grease 68 is extruded around the wire connections. The wire ends are severed and expelled before the cover reaches the fully crimped position and thereafter grease is extruded into and fills the area vacated by the severed wire ends.

In the embodiment of FIGS. 8 through 12 the inclined wall 58 on the body 50 does not make contact with any portion of the cover 54 in the fully crimped position. The end of the connector is thus not fully closed in the same manner as in the first embodiment. For this reason, a hinged door 81 extends from the end of the cover 54. When the body 50 is fully crimped into the cover 54 the door 81 may be pivoted to close the end of the connector adjacent the cut-off leg 65 of the connector element. Wedge shaped latching projections 83 extending from the edges of the door 81 adjacent the end thereof fit into latching recesses 84 in the edge walls of the cover 54 to retain the door in the closed position sealing the end of the connector.

Many other variations of the present invention will be apparent to those skilled in the art. For example, a two wire connector may be constructed for receiving one wire from each end by forming each leg of the connector element with a wire receiving slot and a cut-off edge, the cut-off edge being aligned with the slot in the other leg, and by providing an inclined end wall and a sealing door at the portion of each end adjacent the nearest cut-off edge. As another example, a two wire tap connector may be constructed in which the through wire enters from the side of the connector in its fully open position and only the position for the terminated wire has a cut-off edge, an inclined end wall and means such as a door to seal the end of the connector adjacent the cut-off edge.

I claim:

1. A wire connector comprising:

a hollow, open-topped, insulating body having a base wall, a pair of generally parallel side walls extending generally perpendicularly from said base wall and an end wall extending from said base wall between said side walls at one end of said body, the upper edge of at least a portion of said end wall being inclined at an acute angle to said base wall, and the end of said body opposite said end wall being open for access by at least one wire, a U-shaped, resilient, conductive wire connector element, the legs of the U being wide and thin, one of the legs being formed with at least one wire connecting slot extending from the top of said leg toward the base of said U, the second leg being sharpened along its top edge in alignment with at least one said wire connecting slot in said first leg, said connector element being positioned in said body with the base of the U on said base wall of said body and said second leg abutting and extending above said inclined portion of said body end wall, and an insulating cover formed to telescope with said body, said cover having means to carry a wire into each said connector element slot and to cooperate with said sharpened second leg of said connector element to sever at least one wire extending through said connector upon telescoping of said cover and said body fully together, said body and cover being formed with means to seal the end of said connector adjacent said sharpened second leg of said connector element when said body and cover are fully telescoped together, and complementary latch members to retain said body and cover in an open position to permit at least one wire to be inserted into said body end that is open for access by at least one wire and through said connector between said body and cover, and to retain said body and cover in a crimped position with said cover and body fully telescoped together.

2. The connector of claim 1 wherein said end of said connector open for wire access is open for access by a plurality of wires, said first leg of said wire connector element is formed with a plurality of wire connecting slots and said body end wall is inclined across the width thereof spanning the wire positions thereon aligned with said wire connecting slots in said wire connector element.

3. The connector of claim 1 wherein said hollow body contains grease in and around said connector element to be forced around wires in the connector upon telescoping of said cover into said body thereby to provide a water resistant connection.

4. The connector of claim 1 wherein said body and said cover latch members also retain said body and cover in a precrimped position with said cover and body partially telescoped together and the insulation on wires extending through said connector captured between said base and cover.

5. The connector of claim 1 wherein said means to carry wires into said connector element slots and to cooperate with said sharpened second leg of said connector element to sever wires extending through said connector includes transverse slots in said cover to receive said legs of said connector element.

6. The connector of claim 1, 2 or 3 wherein, between said wire connector element and said body end that is open for wire access, said body is formed with dividers extending from said base wall in a line transverse of said body to define narrow wire passageways, one aligned with each said slot in said connector element.

7. The connector of claim 6 wherein said dividers are spaced a distance less than the diameter of insulated wires to be connected and are formed to indent the wire insulation to provide strain relief.

8. The connector of claim 7 wherein there are two transverse lines of said dividers extending from said base wall of said body.

9. The connector of claim 1, 2 or 3 wherein said means to seal the end of said connector adjacent said sharpened second leg of said connector element when said body and cover are fully telescoped together comprises the end of said cover opposite said inclined edge of said body end wall contacting said inclined edge of said body end wall when said body and cover are fully telescoped together.

10. The wire connector of claim 9 wherein said cover is formed to telescope into said body between said body side walls.

11. The wire connector of claim 1, 2 or 3 wherein said means to seal the end of said connector adjacent said sharpened second leg of said connector element when said body and cover are fully telescoped together comprises a hinged door.

12. The connector of claim 11 wherein said hinged door forms part of said cover.

13. The connector of claim 12 wherein said body is formed to telescope into said cover.

14. The connector of claim 1, 2 or 3 wherein at said end of said body that is open for wire access said connector is formed with one wire insertion port aligned with each wire connecting slot in said wire connector element to aid in guiding wires through said connector between said body and cover in said open position.

15. The connector of claim 14 wherein said wire insertion ports are formed in said cover.

16. The connector of claim 1, 2 or 3 wherein a plurality of stabilizing posts extend from the top edge of said second leg of said connector element and said cover is formed with wells to receive said posts.

17. The connector of claim 16 wherein the ends of said stabilizing ports are barbed and bite into the sidewalls of said wells.

* * * * *